US005183580A

United States Patent [19]

Lew et al.

[11] Patent Number: 5,183,580

[45] Date of Patent: Feb. 2, 1993

[54] LIQUID FABRIC CONDITIONER CONTAINING FABRIC SOFTENER AND GREEN COLORANT

[75] Inventors: Jeanie Lew, Bayside, N.Y.; Barbara H. Bory, Fort Lee, N.J.

[73] Assignee: Lever Brothers Company, Division of Conopco Inc., New York, N.Y.

[21] Appl. No.: 618,443

[22] Filed: Nov. 27, 1990

[51] Int. Cl.[5] ..... D06M 13/00

[52] U.S. Cl. ..... 252/8.6; 252/8.8; 252/8.9

[58] Field of Search ..... 252/8.6–8.9

[56] References Cited

U.S. PATENT DOCUMENTS

| | | | |
|---|---|---|---|
| 3,544,473 | 12/1970 | Kitchen et al. | 252/99 |
| 3,892,669 | 7/1975 | Rapisarda et al. | 252/8.75 |
| 3,940,220 | 2/1976 | D'Arcangeli | 252/90 |
| 4,134,838 | 1/1979 | Hooper et al. | 252/8.8 |
| 4,137,180 | 1/1979 | Naik et al. | 252/8.8 |
| 4,294,711 | 10/1981 | Hardy et al. | 252/8.75 |
| 4,579,559 | 4/1986 | Canela | 252/8.7 |
| 4,654,163 | 3/1987 | Quack et al. | 252/312 |
| 4,767,547 | 8/1988 | Straathof et al. | 252/8.8 |
| 4,789,491 | 12/1988 | Chang et al. | 252/8.6 |
| 4,822,499 | 4/1989 | Wahl et al. | 252/8.8 |
| 4,844,820 | 7/1989 | Piper et al. | 252/8.8 |
| 4,863,620 | 9/1989 | Coffindaffer | 252/8.8 |
| 4,897,208 | 6/1990 | Wahl et al. | 252/8.8 |
| 4,927,555 | 5/1990 | Colarusso, Jr. | 252/99 |
| 4,994,193 | 2/1991 | Wahl | 252/8.8 |

OTHER PUBLICATIONS

*Colour Index*, 3rd Edition, vol. 3, pp. 3354–3355 1971.

*Primary Examiner*—A. Lionel Clingman
*Assistant Examiner*—Bradley A. Swope
*Attorney, Agent, or Firm*—Rimma Mitelman

[57] ABSTRACT

Liquid fabric conditioning compositions of an aesthetically pleasing green color. The compositions incorporate a cationic fabric softening compound and 1 ppm to 1000 ppm of selected green colorants.

11 Claims, No Drawings

LIQUID FABRIC CONDITIONER CONTAINING FABRIC SOFTENER AND GREEN COLORANT

FIELD OF THE INVENTION

The present invention relates to liquid fabric conditioning compositions and conditioning of fabrics in an aqueous wash bath.

BACKGROUND OF THE INVENTION

Liquid fabric conditioning compositions are known in the art. Liquid fabric softening compositions containing a light-stable non-staining pink color are described by Wahl, U.S. Pat. No. 4,822,499. Coffindafer, U.S. Pat. No. 4,863,620 discloses a liquid fabric conditioning composition having a pH of less than 6 and containing specific yellow and blue colorants which provide a yellow color in the composition and which upon dilution and increase of pH to about 7.5 turn blue. A liquid conditioning product of green color has not been described in the art.

It is very difficult to find green dyes that on addition to a liquid conditioning product result in an aesthetically pleasing green-colored product. Many green dyes provide shades of green, but are unaccepatable to a consumer because of potential toxicity or, if safe, because of undesirable dull, drab appearance. Combinations of blue and yellow dyes, such as for instance C.I. Acid Blue #80 and C.I. Acid Yellow #17, for instance, typically provide undesirable color shades.

SUMMARY OF THE INVENTION

The present invention concerns the use in liquid fabric conditioning products of specific green dyes. It has been discovered that incorporation of selected green dyes into liquid fabric conditioning compositions having a pH of less than about 7 results in a product of an aesthetically pleasing green color.

According to the present invention, a liquid fabric conditioning composition is provided having a pH of less than about 7 and containing from about 1% to about 40% of a fabric softening component and about 1 ppm to 1,000 ppm of a colorant system including a colorant selected from the group consisting of C.I. Pigment Green #7, C.I. Reactive Green #12, C.I. Pigment Green #13, C.I. pigment Green #36, C.I. Reactive Green #5, C.I. Reactive Green #18 and mixtures thereof. The fabric softening component employed in the present invention includes a cationic fabric softener.

Liquid conditioning compositions of the present invention include a liquid carrier and may be formulated as diluted or concentrated products.

DETAILED DESCRIPTION OF THE INVENTION

The colorant system of the present invention includes water-soluble or water-dispersible colorants selected from the group consisting of C.I. Pigment Green #7, C.I. Reactive Green #12, C.I. Pigment Green #13, C.I. Pigment Green #36, C.I. Reactive Green #5, C.I. Reactive Green #18 and mixtures thereof.

The preferred colorants are C.I. Pigment Green #7 and C.I. Reactive Green #12. The green colorants employed in the present invention can be obtained from the following suppliers:

| Colorant | Trademark | Supplier |
|---|---|---|
| C. I. Pigment Green #7 | Graphtol Green 5869-2 | Sandoz Chemicals |
| C. I. Reactive Green #12 | Drimarene Brilliant Green X-3G | Sandoz Chemicals |
| C. I. Pigment Green #13 | Chromastral Green | Imperial Chemical Industries |
| C. I. Pigment Green #36 | Cyan Green Y | American Cyanamid |
| C. I. Reactive Green #5 | Pergasol Green 3GAL | Ciba-Geigy |
| C. I. Reactive Green #18 | Sumifix Turquoise Blue RF | Sumitono Chemicals |

It should be understood that equivalent dyes that are not certified but that correspond chemically to the above certified dyes, are also included in the present invention.

The amount of the colorants is in the range of from about 1 ppm to about 1000 ppm, preferably from about 5 ppm to about 200 ppm, most preferably from about 5 ppm to about 100 ppm.

The fabric softening component employed in the present invention includes a cationic fabric softening compound, preferably a quaternary ammonium compound. The counterion may be a halide, such as fluoride, chloride, bromide, or iodide. Other counterions may be employed such as methylsulfate, ethylsulfate, hydroxide, acetate, formate, sulfate, carbonate and the like. Preferably, the counterion is chloride or methylsulfate, chloride being especially preferred for liquid fabric conditioning compositions of the present invention.

Examples of cationic quaternary ammonium salts include, but are not limited to:

(1) Acyclic quaternary ammonium salts having at least two $C_{8-30}$, preferably $C_{12-22}$ alkyl chains, such as: ditallowdimethyl ammonium chloride (Adogen ® from Sherex), di(hydrogenated tallow)dimethyl ammonium chloride (Adogen 442 ® from Sherex), distearyldimethyl ammonium chloride (Arosurf TA-100 ® from Sherex), dicocodimethyl ammonium chloride (Variquat K300 ® from Sherex), and the like;

(2) Cyclic quaternary ammonium salts of the imidazolinium type such as di(hydrogenated tallow)-dimethyl imidazolinium chloride, 1-ethylene-bis(2-tallow-1-methyl) imidazolinium chloride (Varisoft 6112 ® from Sherex) and the like;

(3) Diamido quaternary ammonium salts such as: methyl-bis(hydrogenated tallow amidoethyl)-2-hydroxyethyl ammonium methylsulfate (Varisoft 110 ® from Sherex), methyl bis(tallowamidoethyl)-2-hydroxypropyl ammonium methylsulfate (Varisoft 238 ® from Sherex) and the like;

(4) Biodegradable quaternary ammonium salts such as N,N-di(tallowoyl-oxy-ethyl)-N,N,-dimethyl ammonium chloride and N,N-di(tallowoyl-oxy-propyl)-N,N-dimethyl ammonium chloride.

When fabric conditioning compositions employ biodegradable quaternary ammonium salts, pH of the composition is preferably adjusted to between about 2 and about 5. Biodegradable quaternary ammonium salts mentioned above are described more fully in U.S. Pat. Nos. 4,767,547 and 4,789,491 incorporated by reference herein.

Biodegradable cationic diester compounds may be employed which have the formula:

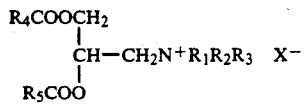

These cationic diesters are described in greater detail in U.S. Pat. No. 4,137,180, which patent is incorporated by reference herein.

(5) Mixtures of water-insoluble cationic fabric softener and a polyalkoxylated ammonium salt as described in U.S. Pat. No. 4,422,949 the disclosure of which is incorporated by reference herein. Such mixtures may be particularly suitable for incorporation in a concentrated form of the liquid compositions herein.

Cationic nitrogenous salts having one long chain acyclic aliphatic $C_{8-30}$ aliphatic group, preferably $C_{12-22}$, may also be employed as the cationic fabric softening compound herein. Examples include but are not limited to:

1) Acyclic quaternary ammonium salts. These include for instance monoalkyltrimethylammonium salts such as monotallowtrimethylammonium chloride, mono(hydrogenated tallow)trimethylammonium chloride, palmityltrimethylammonium chloride and soyatrimethylamonium chloride, sold by Sherex Chemical Company under trademarks Adogen R® 471, Adogen® 441, Adogen® 444 and Adogen® 415. Also included are behenyltrimethyl ammonium chloride, soyadimethylethylammonium ethylsulfate and methylbis(2-hydroxyethyl)octadecylammonium chloride.

2) Substituted imidazolinium salts, such as 1-ethyl-1-(2-hydroxyethyl)-2-isoheptadecylimidazolinium ethylsulfate.

3) Alkylpyridinium salts.

4) Alkanamide alkylene pyridinium salts.

The fabric softening component may include other fabric conditioning compounds in addition to the cationic fabric softening compounds described above. Particularly suitable additional fabric softeners employed herein can be selected from the following classes of compounds:

(i) Tertiary fatty amines having at least one and preferably two $C_8$ to $C_{30}$, preferably $C_{12}$ to $C_{22}$ alkyl chains. Examples include trihydrogenated tallow amine (Adogen 340® from Sherex) and cyclic amines such as 1-(hydrogenate tallow)amidoethyl-2-(hydrogenated tallow) imidazoline. Cyclic amines which may be employed for the compositions herein are described in U.S. Pat. No. 4,806,255, incorporated by reference herein.

(ii) Reaction products of stearic acid and aminoethylethanolamine known as stearamidoethyl ethanolamine (Ceranine base 39® from Sandoz). When fabric conditioning compositions employ such reaction products, pH of the composition is preferably adjusted to between about 2 and about 5.

(iii) Carboxylic acids having 8 to 30 carbon atoms and one carboxylic group per molecule. The alkyl portion has 8 to 30, preferably 12 to 22 carbon atoms. The alkyl portion may be linear or branched, saturated or unsaturated, with linear saturated alkyl preferred. Stearic acid is a preferred fatty acid for use in the composition herein. Examples of these carboxylic acids are commercial grades of stearic acid and the like which may contain small amounts of other acids.

(iv) Esters of polyhydric alcohols such as sorbitan esters or glycerol stearate. Sorbitan esters are the condensation products of sorbitol or iso-sorbitol with fatty acids such as stearic acid. Preferred sorbitan esters are monoalkyl. A common example of sorbitan ester is SPAN60 (ICI) which is a mixture of sorbitan and isosorbide stearates.

(v) Fatty alcohols, ethoxylated fatty alcohols, alkyl phenols, ethoxylated alkyl phenols, ethoxylated fatty amines, ethoxylated monoglycerides, ethoxylated diglycerides, ethoxylated fatt amides (Varamide T55® from Sherex).

(vi) Mineral oils, and polyols such as polyethylene glycol.

Preferred fabric softeners for use herein are acyclic quaternary ammonium salts, ditallowdimethyl ammonium chloride being most preferred for fabric conditioning compositions of the present invention.

An especially preferred fabric softener combination is a combination of an acyclic quaternary ammonium salt and an ethoxylated fatty amide. In particular the ammonium salt, di(hydrogenatedtallow)dimethyl ammonium chloride (Adogen 442® from Sherex) may be combined with the ethoxylated fatty amide, tallow mono ethanolamide (Varamide T-55® from Sherex), preferably in a ratio of from about 10:1 to about 1:1, more preferably in a ratio of from about 6:1 to 1:1. In the most preferred embodiment the ratio of the ammonium salt to the amide is from about 4:1 to about 5:1.

It may be appreciated that various combinations of fabric softening components may be used by the skilled artisan without departing from the scope of the present invention.

About 1% to about 40% of the fabric softening component is used in the compositions of the invention. There must be included at least a sufficient amount of the cationic fabric softening compound to achieve antistatic effect, for example at least about 1% to about 3% in the dilute product and at least about 2% to about 5% in the concentrated product. On the other hand, the entire fabric softening component may be a cationic fabric softening compound. The diluted version of the product contains about 1% to about 12%, preferably about 3% to about 10% and most preferably about 4% to about 7% of the fabric softening component, based on % active. The concentrated version of the product contains about 13% to about 40%, preferably about 13% to 30% and most preferably about 13% to about 20% of the fabric softening component, based on % active.

The fabric conditioning compositions of the present invention include a liquid carrier, which is water and which may additionally contain organic solvents such as lower alcohols selected from, for example, methyl alcohol, ethyl alcohol and isopropanol. Both the diluted and the concentrated versions of the product are preferably dispersions of the active ingredients in the water solvent matrix.

According to the present invention the pH of liquid fabric conditioning compositions is less than about 7, and is preferably in the range of from 4 to 6.5. Typically, there is no need to adjust pH of the compositions. However, if there is a need to adjust pH of the compositions, any acidic material may be used. Examples of suitable acids include hydrochloric, sulfuric, phosphoric, citric, maleic acids and the like. The pH is measured by a glass electrode in comparison with a standard calomel reference electrode.

Various additives may be optionally employed in the conditioning compositions of the present invention.

These include silicones, such as predominantly linear polydialkylsiloxanes, e.g. polydimethylsiloxanes; soil release polymers such as block copolymers of polyethylene oxide and terephthalate fatty amines selected from the group consisting of primary fatty amines, secondary fatty amines, tertiary fatty amines and mixtures thereof; amphoteric surfactants; smectite type inorganic clays; anionic soaps; zwitterionic quaternary ammonium compounds and nonionic surfactants.

Other optional ingredients include emulsifiers, electrolytes (for example, sodium chloride or calcium chloride) preferably in the range from 5 to 500 ppm, optical brighteners or fluorescent agents preferably in the range from 0.01 to 5%, buffers, perfumes preferably from 0.1 to 5%, germicides, bactericides, and bacteriostatic agents. Bacteriostatic agents are preferably employed in the range from 1 to 1000 ppm.

It has been found particularly desirable to include in the inventive compositions deodorant perfumes disclosed in U.S. Pat. No. 4,134,838 incorporated by reference herein. According to the present invention, the compositions preferably include from 0.01 to 10%, preferably 0.1% to 1% by weight of a deodorant perfume described in the '838 patent.

The liquid fabric conditioning compositions can be prepared by conventional methods. A convenient and satisfactory method is to prepare the softening active premix at about 50-80° C, which is the added with stirring to the hot water. Temperature-sensitive components can be added after the fabric softening composition is cooled to a lower temperature. The colorant may be added to the composition at any point. Preferably, the colorant is added to the hot water prior to the mixing with the active premix. The fabric conditioning compositions of the invention can be used in the rinse cycle of a conventional home laundry operation. Generally, rinse water has a temperature of from about 5° C. to about 60° C. The concentration of the total active ingredients is generally from about 2 ppm to about 1000 ppm, preferably from about 10 ppm to about 500 ppm, by weight of the aqueous rinsing bath. When multiple rinses are used, the fabric conditioning compositions are preferably added to the final rinse.

Typically, the amount of staining possibly imparted to the fabric by any fabric softener depends on the type of fabric, the concentration of the dye in the composition, and whether there is a direct contact of the fabric conditioner with the fabric. Preferably, to minimize the possibility of staining, the fabric softener of the present invention is added after a laundry machine is filled or at least partially filled with water, in order to avoid direct contact of the fabric softener with fabrics in the wash. Alternatively, the fabric softener composition may be diluted with at least about an equal amount of water, and the resulting mixture may be introduced in a washing machine before or during the rinse cycle. The compositions of the invention are substantially non-staining.

The following Examples will more fully illustrate the embodiments of this invention. All parts, percentages and proportions referred to herein and in the appended claims are by weight of the composition unless otherwise indicated.

EXAMPLE 1

| Ingredient | % by Weight | | | | |
|---|---|---|---|---|---|
| | A | B | C | D | E |
| Adogen ® 442 | 8.33 | 8.34 | 8.33 | 8.33 | 8.28 |
| Ucarcide ® Antimicrobial 250[1] | 0.14 | 0.14 | 0.14 | 0.14 | 0.14 |
| Perfume | 0.35 | 0.35 | 0.35 | 0.35 | — |
| Calcium Chloride (10%) | 0.20 | 0.17 | 0.12 | 0.12 | 0.37 |
| C. I. Pigment Green #7 (1%) | 0.20 | — | — | — | 0.10 |
| C. I. Reactive Green #12 (1%) | — | 0.40 | — | — | — |
| FD & C Green #3 (1%)[2] | — | — | 0.08 | — | — |
| C. I. Acid Blue #80[3] (1%) | — | — | — | 0.20 | — |
| C. I. Acid Yellow #17[4] (1%) | — | — | — | 0.12 | — |
| Water | BALANCE | | | | |
| pH | 3.9 | 5.1 | | | 4.9 |

[1]Obtained from Union Carbide Corp.
[2]Obtained from Warner-Jenkinson Corp.
[3]Obtained from Sandoz
[4]Obtained from Sandoz The above compositions A through E were prepared as follows: Adogen 442 ® was heated to 140° F. The aqueous phase was prepared by mixing and heating to about 140° F. Ucarcide° antimicrobial, calcium chloride, and the colorant in water. Subsequently, Adogen 442 ® was added with stirring to the aqueous phase.

Compositions A, B and E which are within the scope of the invention provided consumer desirable bright green colors of different shades. Compositions A, B and E were also acceptably stable when exposed to sunlight for more than seven days. Compositions C and D which are not within the scope of the invention provided undesirable dull, drab olive green colors.

EXAMPLE 2

| Ingredient | Wt % |
|---|---|
| 1-trimethyl ammonium 2,3-di($C_{14}$–$C_{18}$ acyloxy) propane chloride | 8.33 |
| Ucarcide Antimicrobial 250 ® | 0.14 |
| C. I. Pigment Green #7 (1%) | 0.10 |
| Calcium Chloride (10%) | 0.60 |
| Perfume | 0.30 |
| Water | Balance |
| pH | 2.5 |

The composition of Example 2 was prepared as in Example 1, except that the fabric softener was heated to 170° F.

This composition was stable at room temperature for at least about 3 months. It was also stable in sunlight for more than 7 days. The composition has an aesthetically pleasing green color of a lighter shade than the colors obtained for compositions A, B and E in Example 1.

EXAMPLE 3

To determine whether direct contact of a liquid fabric conditioning product causes staining by colorant on the fabric, the Direct Staining Test was conducted as follows:

APPARATUS, MATERIALS 250 ml beaker
Glass stirring rod
5.75"×5.75" swatches of:
- Terry cloth
- 65/35 Dacron/cotton permanent press
- Diaper (100% cotton Birdseye type)
- Lycra
- Silk Wool 65/35 Dacron/cotton
Acetate Rayon Taffeta
Spun Dacron
Spun Nylon
Spun Arnel
Spun Orlon
Spun Viscose
Banlon
Wool flannel
Texturized polyester twill
Polyester double knit
½ teaspoon measure
Kenmore® washing machine - Model 70 or equivalent
Detergent
Medicine dropper Procedure Fabric swatches were washed in 100° F. water with detergent. At the completion of the wash, the machine was allowed to spin only long enough to remove excess wash solution. The cloths were not spray rinsed or rinsed in any way. All cloths were removed from the washing machine and dried in a static dryer. After drying, 20 drops of fabric conditioner were applied directly to the cloths and the cloths were folded with pressure in order to obtain about a 2" circle. The stained cloths were allowed to age about 24 hours, then put through a rinse cycle only in the Kenmore® washing machine (no additional softener was added). The cloths were dried again. The cloths were evaluated under simulated northern daylight and rated for residual staining according to the following system:

0 - no staining
2 - trace
4 - slight
6 - moderate
8 - considerable

The scores obtained for each cloth were then added to obtain a total staining score. The test was repeated for every fabric conditioning composition that wa tested. The lower the total staining score, the less staining there was.

The test compared the amount of staining produced by Compositions A and E (prepared in Example 1) to the amount of staining produced by commercial colored compositions I and II, the commercial compositions not being within the scope of the present invention.

| | Total Staining Score |
|---|---|
| TEST I | |
| Composition A | 84 |
| Commercial colored composition I | 84 |
| Commercial colored composition II | 96 |
| TEST II | |
| Composition E | 56 |
| Commercial colored composition I | 94 |

It can be seen that Compositions A and E which are within the scope of the invention do not stain any worse than commercial colored compositions.

EXAMPLE 4

The test was carried out to compare stain build-up effects under normal usage conditions from the conditioning composition according to the present invention (Composition E prepared in Example 1) and from a commercial composition. Two hand towels were given to each of 12 panelists who were asked to use them for 3 days. The towels were then returned for washing and rinsing in the respective softeners. The fabric softeners were diluted with an about equal amount of water and were added to an approximately half-filled aqueous bath. This cycle of usage and product treatment was repeated for 10 times.

The towels were assessed after 1, 5, and 10 times. A visual examination of the towels showed that there was no staining on any of the towels.

What is claimed is:

1. A green-colored opaque fabric conditioning composition comprising:

a) about 1% to about 40% by weight of said composition of a fabric softening compound selected from the group consisting of di(hydrogenatedtallow)-dimethyl ammonium chloride, cyclic quarternary ammonium salts, diamido quaternary ammonium salts, cationic nitrogenous salts having one long chain acyclic aliphatic $C_{8-30}$ group, substituted imidazolinium salts, alkyl pyridinium salts, alkanamide alkylene pyridinium salts, tertiary fatty amines having at least one $C_{8-30}$ alkyl chain, reaction products of stearic acid and aminoethylethanolamine, carboxylic acids having 8 to 30 carbon atoms and one carboxylic group per molecule, esters of polyhydric alcohols, fatty alcohols, ethyoxylated fatty alcohols, alkyl phenols, ethoxylated alkyl phenols, ethoxylated fatty amines, ethoxylated monoglycerides, ethoxylated diglycerides, ethoxylated fatty amides, mineral oils, polyols, and quaternary amonium compound of the formula:

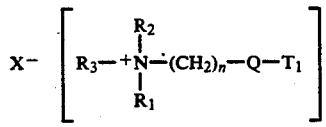

or

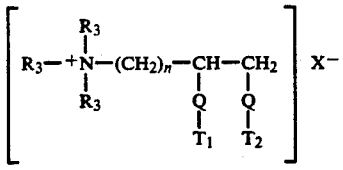

wherein,

Q is

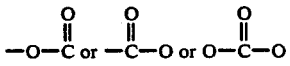

$R_1$ is $(CH_2)_n$—Q—$T_2$ or $T_3$;
$R_2$ is $(CH_2)_n$—Q—$T_4$ or $T_5$ or $R_3$;
$R_3$ is $C_1$-$C_4$ alkyl;
n is an integer from 1 to 4; and
$X^-$ is a softener-compatible anion;

a quaternary ammonium softening compound of the formula:

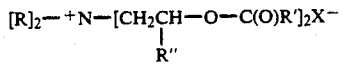

wherein each R substituent is a short-chain alkyl or hydroxyalkyl group or mixtures thereof; each R′ is a long-chain hydrocarbyl substituent, and R″ is a short-chain ($C_1$–$C_4$) hydrocarbyl substituent, and $X^-$ is as defined above;

a cationic diester of the formula:

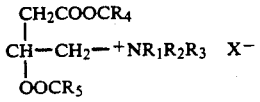

wherein $R_1$, $R_2$ and $R_3$ are each an alkyl or hydroxyalkyl group containing from 1 to 4 carbon atoms, or a benzyl group, $R_4$ and $R_5$ are ach alkyl chains containing from 11 to 23 carbon atoms, and $X^-$ is a water soluble anion, and mixtures thereof; and b) about 1 ppm to about 1,000 ppm of a colorant system comprising a colorant selected from the group consisting of C.I. Pigment Green #7, C.I. Reactive Green #12, C.I. Pigment Green #13, C.I. Pigment Green #36, C.I. Reactive Green #5, C.I. Reactive Green #18 and mixtures thereof; and c) a liquid carrier including water, the pH of the composition being less than about 7.

2. The composition of claim 1 wherein the colorant is selected from the group consisting of C.I. Pigment Green #7, C.I. Reactive Green #12 and mixtures thereof.

3. The composition of claim 1 wherein the composition comprises about 5 ppm to about 200 ppm of the colorant system.

4. The composition of claim 1 wherein the composition comprises about 5 to about 100 ppm of the colorant system.

5. The composition of claim 1 wherein the composition comprises about 4% to about 35% of the fabric softening component.

6. The composition of claim 1 wherein the composition comprises about 4% to about 30% of the fabric softening component.

7. The composition of claim 1 wherein the fabric softening component is selected from the group consisting of acyclic quaternary ammonium salts having at least two $C_{8-30}$ alkyl chains, quaternary imidazolinium salts, diamido quaternary ammonium salts, biodegradable quaternary ammonium salts and mixtures thereof.

8. The composition of claim 1 wherein the fabric softening component is selected from the group consisting of dihydrogenatedtallowdimethyl ammonium chloride and ditallowimidazolinium chloride.

9. The composition of claim 1 wherein the pH of the composition is about 4 to about 6.5.

10. A method for softening fabrics comprising treating the fabrics in an aqueous bath with the fabric conditioning composition of claim 1.

11. The composition of claim 1 wherein the fabric softening component consists essentially of di(hydrogenatedtallow)dimethyl ammonium chloride.

* * * * *